US011225086B2

(12) United States Patent
Cumbie et al.

(10) Patent No.: US 11,225,086 B2
(45) Date of Patent: Jan. 18, 2022

(54) THERMAL CONTACT DIES

(71) Applicant: HEWLETT-PACKARD DEVELOPMENT COMPANY, L.P., Spring, TX (US)

(72) Inventors: Michael W Cumbie, Corvallis, OR (US); Reynaldo V Villavelez, Corvallis, OR (US); Chien-Hua Chen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 303 days.

(21) Appl. No.: 16/466,408

(22) PCT Filed: Mar. 15, 2017

(86) PCT No.: PCT/US2017/022573
§ 371 (c)(1),
(2) Date: Jun. 4, 2019

(87) PCT Pub. No.: WO2018/169527
PCT Pub. Date: Sep. 20, 2018

(65) Prior Publication Data
US 2021/0283926 A1 Sep. 16, 2021

(51) Int. Cl.
*B41J 2/335* (2006.01)

(52) U.S. Cl.
CPC ..... *B41J 2/3352* (2013.01)

(58) Field of Classification Search
CPC ..... B41J 2/3352
See application file for complete search history.

(56) References Cited

U.S. PATENT DOCUMENTS 3,852,563 A 12/1974 Bohorquez et al.
4,030,408 A * 6/1977 Miwa ..... B41J 2/3357 347/208
5,122,812 A * 6/1992 Hess ..... B41J 2/14129 257/379
5,635,968 A 6/1997 Bhaskar et al.
6,378,984 B1 4/2002 Steinfield et al.
6,543,883 B1 4/2003 Dodd et al.
(Continued)

FOREIGN PATENT DOCUMENTS

CN 1654221 8/2005
CN 2743136 11/2005
(Continued)

OTHER PUBLICATIONS

The Third-generation HP Thermal Inkjet Printhead the Monolithic Integration of Driver Transistors with the Thermal Inkjet Heater Resistors Leads to Vastly Improved Performance with Reduced Cost Per Page for the Customer Sep. 13, 2016.

*Primary Examiner* — Yaovi M Ameh
(74) *Attorney, Agent, or Firm* — Fabian VanCott

(57) ABSTRACT

A thermal contact device may include a thermal contact die embedded in a moldable material. The thermal contact die may include a number of resistors integrated into the thermal contact die, and a number of heater drivers integrated into the thermal contact die and electronically coupled to the resistors. The moldable material is coplanar with a thermal contact side of the thermal contact device. Further, the moldable material includes at least one gradient edge along a medium feed path.

15 Claims, 10 Drawing Sheets

(56) References Cited

U.S. PATENT DOCUMENTS

| | | | | |
|---|---|---|---|---|
| 7,699,440 | B2 | 4/2010 | Silverbrook | |
| 7,934,809 | B2 | 5/2011 | Silverbrook et al. | |
| 2007/0257980 | A1* | 11/2007 | Koyama ..... | B41J 2/33585<br>347/208 |

FOREIGN PATENT DOCUMENTS

| | | |
|---|---|---|
| CN | 101417546 | 4/2009 |
| CN | 103101323 | 5/2013 |
| CN | 105163943 | 12/2015 |
| EP | 0235827 | 9/1987 |
| EP | 1080922 | 3/2001 |
| EP | 2059090 | 5/2009 |
| GB | 2052394 | 1/1981 |
| JP | S581576 | 1/1983 |
| WO | WO-2015080730 | 6/2015 |

* cited by examiner

10/10

| ETC Run # | Passivation Layer Thickness (μm) | Thermal Diffusion Layer Thickness (μm) | Si Layer Thickness (μm) | Moldable Material Thickness (μm) | Drive Voltage (V) | Peak Temperature (°C) | |
|---|---|---|---|---|---|---|---|
| | | | | | | X-axis | Y-axis |
| Sim9044_run0 | 1 | 0 | 100 | 100 | 15 | 76 | 86 |
| Sim9044_run1 | 1 | 0 | 100 | 100 | 25 | 173 | 200 |
| Sim9044_run2 | 1 | 0 | 100 | 100 | 30 | 245 | 286 |
| Sim9058_run0 | 1 | 8 | 100 | 100 | 15 | 105 | 123 |
| Sim9058_run1 | 1 | 8 | 100 | 100 | 25 | 258 | 312 |
| Sim9058_run2 | 1 | 8 | 100 | 100 | 30 | 373 | 455 |
| Sim9059_run0 | 1 | 0 | 100 | 0 | 15 | 76 | 85 |
| Sim9059_run1 | 1 | 0 | 100 | 0 | 25 | 172 | 199 |
| Sim9059_run2 | 1 | 0 | 100 | 0 | 30 | 243 | 283 |
| Sim9060_run0 | 1 | 8 | 100 | 0 | 15 | 105 | 122 |
| Sim9060_run1 | 1 | 8 | 100 | 0 | 25 | 257 | 311 |
| Sim9060_run2 | 1 | 8 | 100 | 0 | 30 | 372 | 454 |

*Fig. 10*

1000

THERMAL CONTACT DIES

BACKGROUND

Thermal contact printing may be defined as any process that uses heat to produce an image on a print medium. Thermal contact printing devices may use a thermal array that applies pixel-by-pixel heat to a thermochromatic print medium, a dye-containing ribbon causing the dye from the ribbon to transfer to a receiver substrate, or other processes of creating on or transferring colorant to a substrate.

BRIEF DESCRIPTION OF THE DRAWINGS

The accompanying drawings illustrate various examples of the principles described herein and are a part of the specification. The illustrated examples are given merely for illustration, and do not limit the scope of the claims.

FIG. 10 is a table depicting a thermal profile of two adjacent heating elements within a thermal contact die, according to one example of the principles described herein.

Figure 1:
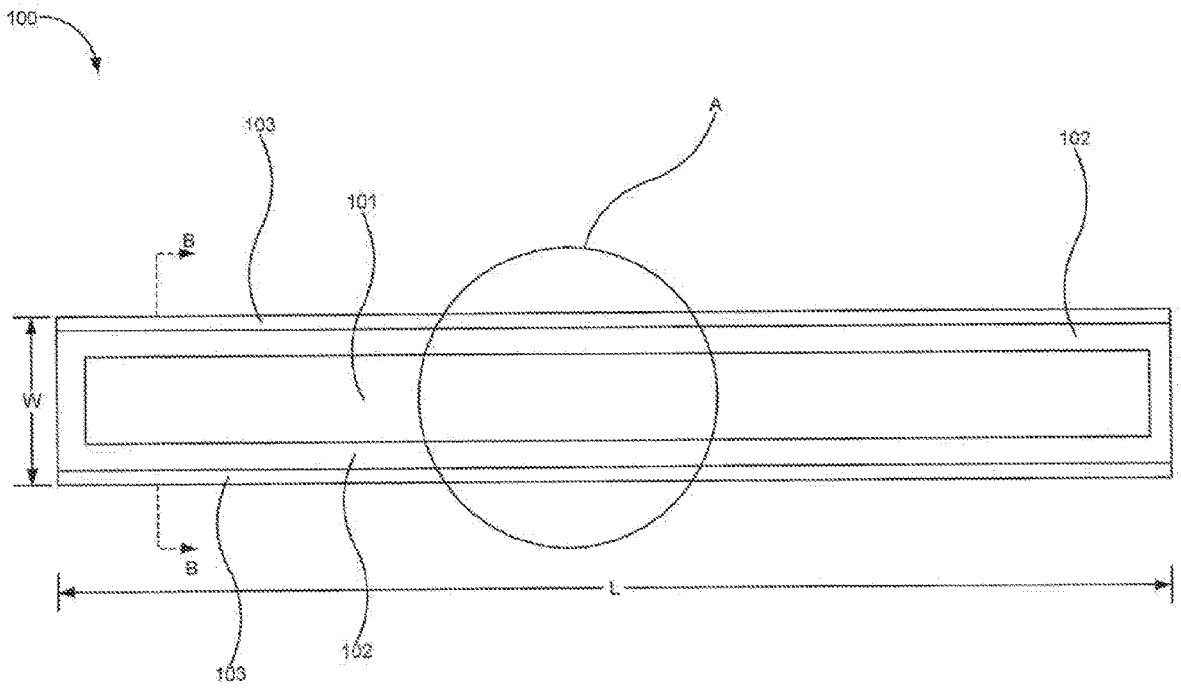
FIG. 1 is a top plan view of a thermal contact die, according to one example of the principles described herein.

Throughout the drawings, identical reference numbers designate similar, but not necessarily identical, elements. The figures are not necessarily to scale, and the size of some parts may be exaggerated to more dearly illustrate the example shown. Moreover, the drawings provide examples and/or implementations consistent with the description; however, the description is not limited to the examples and/or implementations provided in the drawings.

DETAILED DESCRIPTION

In some thermal contact printing devices, a number of heating elements such as resistors may be included within a die. The heating resistors may be selectively activated using, for example, a type of transistor or other driver integrated circuit (IC) to form an image on a target print medium. However, the inclusion of the driver IC within the thermal contact printing device to drive the heating resistors limits the size of the die and the number of heating resistors within the die. This is because it may be difficult to physically fanout the elements within and coupled to the die. Further, the cost of fanning out the elements within and coupled to the die may increase as a higher density of heating resistors is proposed. In this situation, the physical fanning out of the elements within and coupled to the die may increase the costs associated with materials and manufacturing of the die and the thermal contact printing device.

Still further, costs associated with manufacturing of the die may increase due to the intricacy of the layout of the elements within the thermal contact printing device. Integration of the driver ICs on the die may also be expensive as it may take up space on the die, causing more material such as expensive silicon to be used within the die.

Examples described herein provide a thermal contact device. The thermal contact device may include a thermal contact die embedded in a moldable material. The thermal contact die may include a number of resistors integrated into the thermal contact die, and a number of heater drivers integrated into the thermal contact die and electronically coupled to the resistors. The moldable material is coplanar with a thermal contact side of the thermal contact device. Further, the moldable material includes at least one gradient edge along a medium feed path.

The thermal contact device may further include a thermal diffusion layer within the thermal contact die to increase the thermal resistivity of the thermal contact die. The thermal diffusion layer may include a silicate glass, a phosphosilicate glass (PSG), a borophosphosilicate glass (BPSG), a silicon nitride ($Si_3N_4$), silicon carbide (SiC), other thermal diffusion materials, and combinations thereof.

The thermal contact device may further include application specific control logic within the thermal contact die. Further, the heater drivers may be field effect transistors (FETs). In one example, the silicon die may be between 50 and 675 micrometers (μm) in thickness.

Examples described herein also provide a print bar. The print bar may include a plurality of thermal contact dies embedded in a moldable material. Each of the thermal contact dies may include a number of resistors integrated into the thermal contact die, a number of heater drivers integrated into the thermal contact die and electronically coupled to the resistors, and a thermal diffusion layer within the thermal contact die to increase the thermal resistivity of the thermal contact die. In one example, the moldable material may be coplanar with a thermal contact side of the thermal contact device, and the moldable material comprises at least one gradient edge along a medium feed path. In one example, the thermal diffusion layer may include a silicate glass, a phosphosilicate glass (PSG), borophosphosilicate glass (BPSG), silicon nitride ($Si_3N_4$), and combinations thereof. Instructions to actuate the resistors may be sent to the heater drivers in serial. The thermal contact dies may further include a passivation layer deposited on the resistors.

Examples described herein also provide a thermal contact structure. The thermal contact structure may include a thermal contact die at least partially overmolded in a moldable material. The thermal contact die may include a number of resistors integrated into the thermal contact die, and a number of heater drivers integrated into the thermal contact die and electronically coupled to the resistors. The moldable material may extend from the thermal contact die past a print zone. Further, the moldable material may be coplanar with a thermal contact side of the thermal contact device. Still further, the moldable material may include at least one gradient edge along a medium feed path. A heat exchanger thermally coupled to the thermal contact die may also be included.

The thermal contact structure may further include a thermal diffusion layer within the thermal contact die to increase the thermal resistivity of the thermal contact die. The thermal diffusion layer comprises a silicate glass, a phosphosilicate glass (PSG), borophosphosilicate glass (BPSG), silicon nitride ($Si_3N_4$) or combinations thereof.

As used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may or may not be included in other examples.

Figure 2:
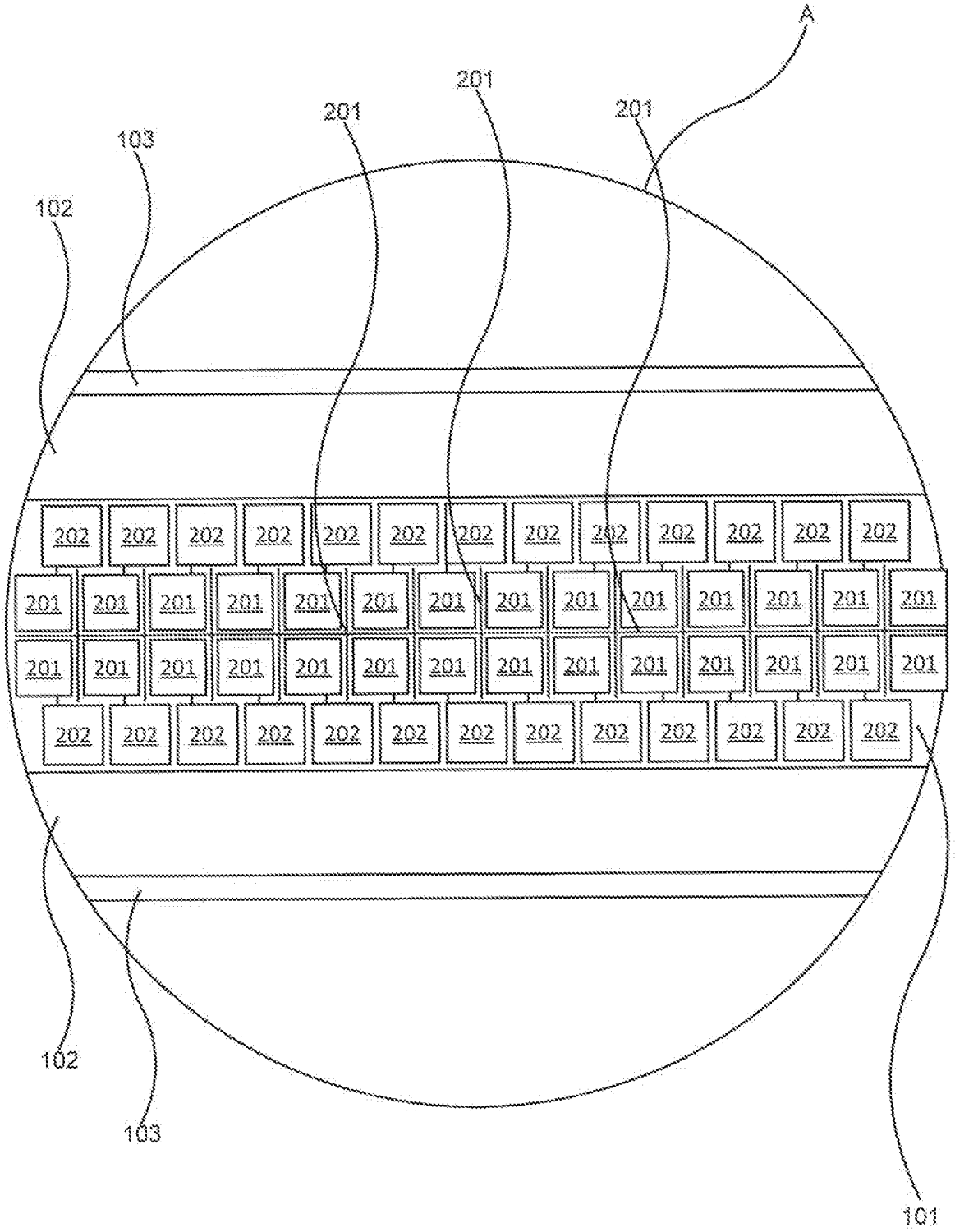
FIG. 2 is a top plan view of the thermal contact die of FIG. 1 within circle A of FIG. 1, according to one example of the principles described herein.

Turning now to the figures, FIG. 1 is a top plan view of a thermal contact die (100), according to one example of the principles described herein. Further, FIG. 2 is a top plan view of the thermal contact die of FIG. 1 within circle A of FIG. 1, according to one example of the principles described herein. The thermal contact die (100) may include a sliver die (101) embedded within a moldable material (102). In one example, the sliver die (101) may include a silicon die, a number of heating elements (201), a number of heating element drivers (202), heat sinks, passivation layers, a number of coatings, a number of silicate glass layers, other layers or material, and combinations thereof. Further, in one example, the sliver die may be between 50 and 675 micrometers (μm) in thickness.

The moldable material (102) may include any material into which the various elements of the thermal contact die (100) may be molded. In one example, the moldable material (102) is a plastic, epoxy mold compound (EMC), or other moldable material (102). In one example, the thermal contact die (100) may include at least one sliver die (101) compression molded into a monolithic body of the moldable material (102). For example, a print bar including at least one sliver die (101) may include a plurality of sliver dies (101) molded into an elongated, singular molded body. The molding of the sliver dies (101) within the moldable material (102) enables the use of smaller sliver dies (101) by off-loading the print zone and other areas of the thermal contact die (100) that receive pressure from elements that contact the thermal contact die (100) such as, for example, a pinch roller, to the molded body (102) of the thermal contact die (100). In this manner, the molded body (102) effectively grows the size of the thermal contact die (100), which, in turn, improves the strength of the thermal contact die (100), decreases costs associated with materials within the sliver dies (101), and provides for attaching the thermal contact die (100) to other structures within, for example, a housing or support structure within a thermal contact printing device.

A sliver die (101) includes a thin silicon, glass, or other substrate having a thickness on the order of approximately 675 micrometers (μm) or less, and a ratio of length to width (L/W) of at least three. In one example, the sliver die (101) may have a width of approximately 300 to 500 μm.

The thermal contact die (100) may have a width (W) that is at least as large as a print zone. In one example, the print zone relative to the thermal contact die (100) may be defined as the area that comes into contact with a pinch roller. In another example, the width (W) may be larger than the print zone. In this example, the moldable material (102) may be extended further in the direction of the arrows associated with designator W, and may cause the thermal contact die (100) to be more robust, easier to handle during manufacturing, and may increase the strength of the thermal contact die (100) overall.

Further, the thermal contact die (100) may have a length (L) that is at least as wide as a print zone. In one example, the length (L) of the print zone relative to the thermal contact die (100) may be at least as wide as a widest print medium that may be printed within a printing device in which the thermal contact die (100) is included. In one example, the thermal contact device (100) may include a plurality of thermal contact dies (100) arranged along the length of the thermal contact device (100). Further, in one example, the thermal contact dies (100) may be positioned in the moldable material (102) of the thermal contact device (100) such that the heating elements (201) may be generally arranged end-to-end along a length of the thermal contact device (100). In this manner, the heating elements (201) may interface with and be used to print at any portion of the print medium.

In one example, the moldable material (102) may be formed coplanar with a thermal contact side of the thermal contact die (100). In this manner, a print medium such as thermal contact paper may travel along the surface of the thermal contact die (100) without the potential for the print medium becoming jammed between the thermal contact die (100) and a pinch roller.

Further, in another example, the moldable material (102) may include at least one gradient edge (103) along a medium feed path. The gradient edge (103) may include a beveled or curved edge that allows a print medium forced between the thermal contact die (100) and a pinch roller to engage with the thermal contact dies (100) and pinch roller without being forced into a rigid edge of the thermal contact die (100). The gradient edge (103) may be formed during a singulation process in which individual thermal contact dies (100) are separated from one another.

With reference to FIG. 2, the heating elements (201) and heating element drivers (202) may be electrically coupled in order for the heating element drivers (202) to actuate the heating elements (201) based on signals sent to the heating element drivers (202). Two rows of heating elements (201) are depicted in FIG. 2. However, any number of rows of heating elements may be included within the thermal contact die (100) to provide for more or less heating element density. The density of the heating elements (201) is equivalent to the pixel density that may be realized within an image printed on a print medium. In one example, a number of trenches (201) may be defined in the sliver die (101) of the thermal contact die (100) between the heating elements (201) to reduce or eliminate cross-talk between the heating elements (201). In one example, the heating elements (201) may be arranged within the thermal contact die (100) to create any pixel density, and may include, for example, 300, 600, 1200, 2400 dots-per-inch (dpi), or other dpi values.

In one example, the density of the heating elements (201) may be increased to address writing system issues of cyan, magenta, and yellow color planes. In some examples, different amounts of time and temperatures may be used to write different color planes of cyan, magenta, and yellow to the print medium. The increased density of the heating elements (201) allows for these various temperature and time ranges to be realized since more heating elements (201) are available to be activated to accommodate for these different color planes.

Further, the heating element drivers (202) are also arranged in two rows surrounding the heating elements (201) so that the heating element drivers (202) may be electrically coupled to the heating elements (201). Although the heating elements (201) and heating element drivers (202) are arranged in the manner depicted in FIG. 2, the heating elements (201) and heating element drivers (202) may be arranged in any manner within the sliver dies (101) to allow for consideration of pixel densities, electrical interconnections, and other arrangement-driven considerations. For example, the heating elements (201) may be arranged along an edge, at the center, or other portions of the sliver die (101). The examples described herein provide for the ability to include more heating elements (201) per linear inch relative to other technologies.

In one example, the heating elements (201) may be any electrical device that is capable of producing heat based on signals sent from the heating element drivers (202). In one example, the heating elements (201) are resistors. The heating elements (201) may be integrated into the sliver die (101) at any layer of the sliver die (101).

In one example, the heating element drivers (202) may be any transistor device capable of switching electronic signals and electrical power to the heating elements (201). For example, the heating element drivers (202) may be a transistor, a bi-polar junction transistor (BJT), a field effect transistor (FET), a junction gate field-effect transistor (JFET), a metal-oxide-semiconductor field-effect transistor (MOSFET), a complimentary metal-oxide-semiconductor (CMOS), CD40-type circuits, jet MOS circuits, a thin-film transistor, other types of transistor devices, and combinations thereof. In one example, the heating element drivers (202) may be embodied as integrated circuits (ICs). The heating element drivers (202) may be integrated into the sliver die (101) at any layer of the sliver die (101). In examples where a CMOS or similar device is employed, these devices provide for the transmission of serial data as opposed to transmission of parallel data using direct drive heaters that may be located off the sliver die (101). Further, application specific control logic may be included with or as part of the heating element drivers (202). The application specific control logic serves to define the sequence at which the heating element drivers (202) are activated.

Figure 3:
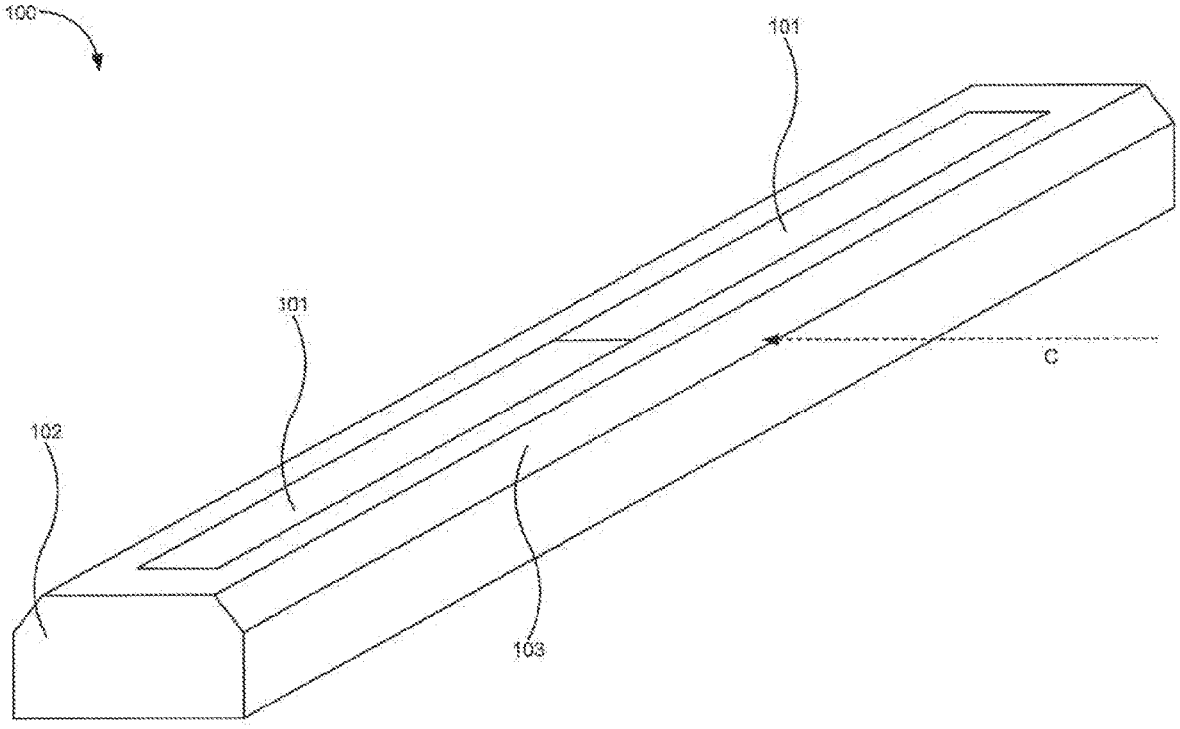
FIG. 3 is a perspective view of a thermal contact device, according to one example of the principles described herein.

FIG. 3 is a perspective view of a thermal contact device (100), according to one example of the principles described herein. As depicted in FIG. 3, the thermal contact device (100) may include a plurality of sliver dies (101). In this example, inline stitching may be used to ensure that a gap in thermal contact does not occur between the two sliver dies (101). In this example, the heating elements (201) may be spaced apart from one another to provide for a 300 dot-per-inch (dpi) resolution that allows for tolerances to stich inline. In another example, a number of additional passes of the print medium across the thermal contact device (100) may be performed to cover a stich joint if one exists based on the density of the heating elements (201) within the sliver dies (101).

Further, as depicted in FIG. 3, the moldable material may include at least one gradient edge (103) along a medium feed path. The medium feed path is indicated by arrow C. The gradient edge (103) may include a beveled edge as depicted in FIG. 3, or a curved edge that allows a print medium forced between the thermal contact die (100) and a pinch roller to engage with the thermal contact dies (100) and pinch roller without being forced into a rigid edge of the thermal contact die (100). In one example, the gradient edge (103) may be cut during a singulation process in which individual thermal contact dies (100) are separated from one another. In another example, the gradient edge (103) may be formed during a molding process of the moldable material (102).

Figure 4:
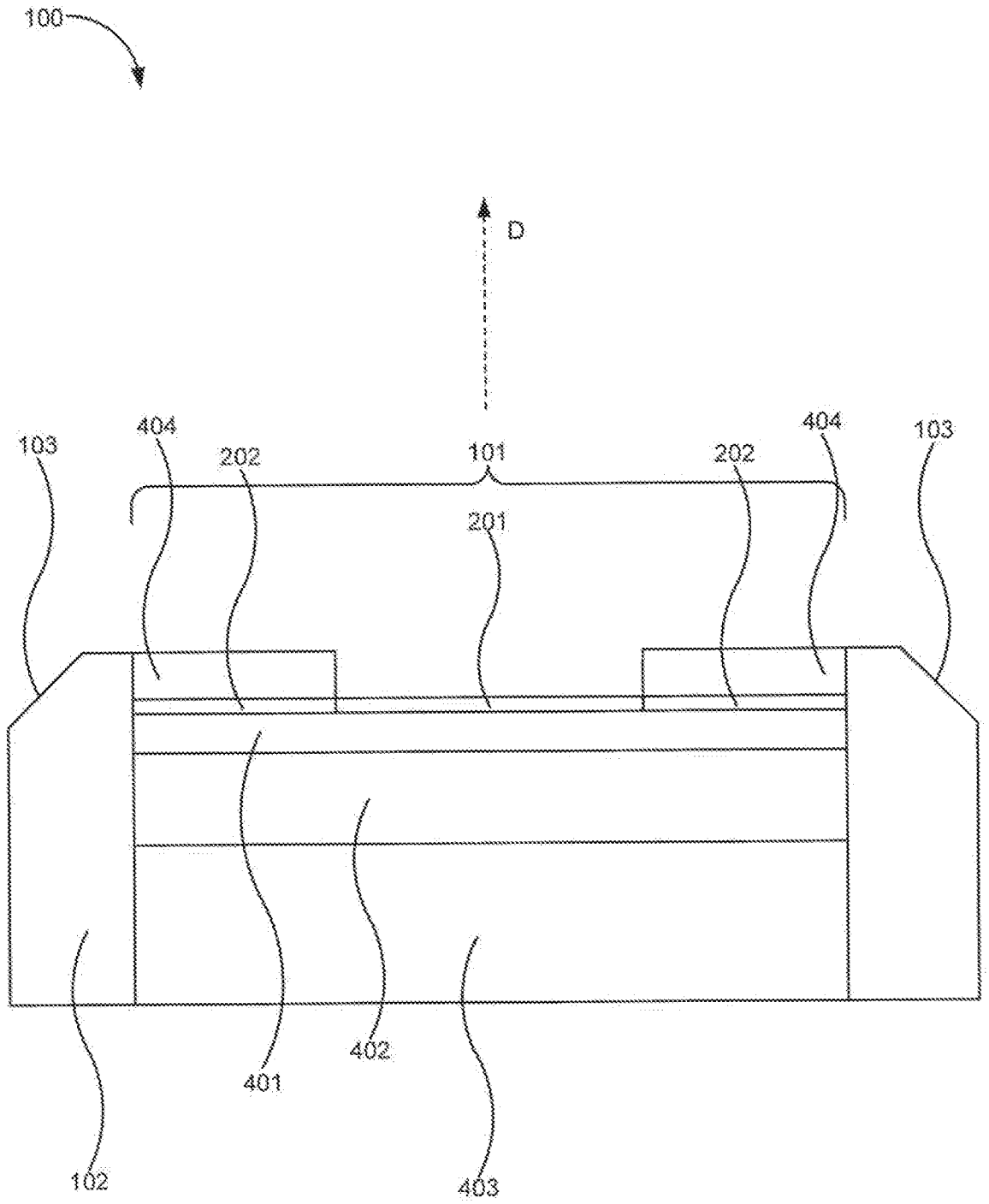
FIG. 4 is a cutaway view of a thermal contact die along line B of FIG. 1, according to one example of the principles described herein.

FIG. 4 is a cutaway view of a thermal contact die (100) along line B of FIG. 1, according to one example of the principles described herein. In the example of FIG. 4, the thermal contact die (100) may include a number of heating elements (201) and a number of heating element drivers (202). In one example, the heating element drivers (202) may be formed underneath an aluminum layer (404). The aluminum layer (404) may be approximately 0.9 micrometers (μm) thick.

A layer of tetraethyl orthosilicate ($Si(OC_2H_5)_4$ (TEOS) may be deposited between the heating elements (201) and heating element drivers (202), and a thermal diffusion layer (402). The thermal diffusion layer (402) may be approximately 10 μm thick, and causes a silicon layer (403) to have an increased thermal resistivity, and causes more heat produced by the heating elements (201) to move out of the architecture of the thermal contact die (100) in the direction of arrow D and towards a print medium that is printed on using the thermal contact die (100).

In one example, the thermal diffusion layer (402) may be buried within the sliver die (101). Further, in one example, the thermal diffusion layer (402) may be made of a doped material. In one example, the thermal diffusion layer (402) may include a silicate glass, a phosphosilicate glass (PSG), a borophosphosilicate glass (BPSG), a silicon nitride ($Si_3N_4$), other thermal diffusion materials, and combinations thereof. The silicon layer (403) may be deposited beneath the thermal diffusion layer (402). The moldable material (102) is molded around at least a portion of the sliver die (101). The inclusion of a silicon-based sliver die (101) including the silicon layer (403) provides for the ability to thin the silicon layer (403) to a thickness that is tuned to improve the thermal performance of the thermal contact die (100). In one example, the sliver die may be thinned to be between 50 and 675 μm in thickness in order to obtain a superior thermal performance.

Figure 5:
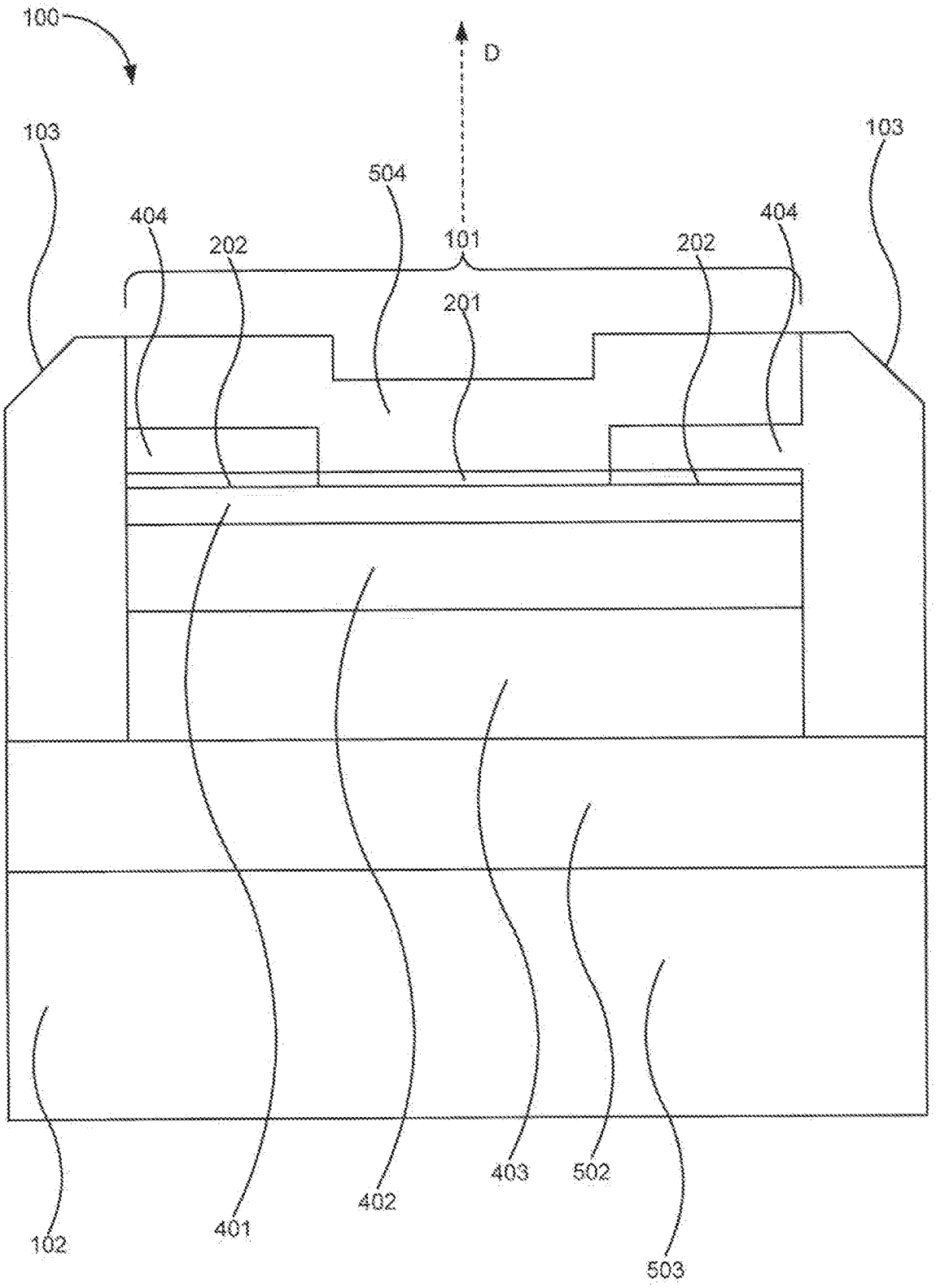
FIG. 5 is a cutaway view of a thermal contact die along line B of FIG. 1, according to another example of the principles described herein.

FIG. 5 is a cutaway view of a thermal contact die (100) along line B of FIG. 1, according to another example of the principles described herein. Those elements similarly numbered in FIG. 5 relative to FIGS. 1 through 4 are described above in connection with FIGS. 1 through 4, and other portions herein. The example thermal contact die (100) of FIG. 5 may further include a passivation layer (504) deposited on the heating elements (201) and the aluminum layer (404). The passivation layer (504) adds mechanical robustness to the thermal contact die (100) so that it can withstand pressures applied on the thermal contact die (100) from a pinch roller and the print medium that interacts with the thermal contact die (100).

Further, the passivation layer (504) electrically isolates and insolates the thermal contact die (100) from other elements within, for example, a thermal contact printing device in which the thermal contact die (100) is included. The dielectric constants of the passivation layer (504) may be higher than, for example, those materials used as the thermal diffusion layer (402). In one example, the materials used on the passivation layer (504) and the thermal diffusion layer (402) may have different dielectric constants.

Still further, the passivation layer (504) acts to aid in heat transfer from the heating elements (201) within the sliver die (101) to the print medium during printing to the print medium. The passivation layer (504) may be made of, for example, silicon carbide (SiC), silicon mononitride (SiN), silicon nitride ($Si_3N_4$), TEOS, doped passivation materials, other electrically isolating, thermally conductive passivation materials, and combinations thereof.

Still further, the passivation layer (504) acts to protect the print medium from burning if the print medium were to come into direct contact with the heating element (201), and create a flat surface over which the print medium. In this manner, the passivation layer (504) acts as both an insulator of extreme heat produced by the heating elements (201) and as a heat conductor to ensure that enough heat from the heating elements (201) is transmitted to the printing medium.

Having described the thermal diffusion layer (402) and the passivation layer (504), Table 1 includes a number of properties of a number of materials used in the thermal diffusion layer (402) and the passivation layer (504).

TABLE 1

Material Properties

| Material | Thermal Conductivity (W/mK) | Heat Capacitance ($mJ/mm^3K$) | Heat Capacitance ($J/m^3K$) |
|---|---|---|---|
| Y-doped SiN | 30.0 | 2.00 | 2.00E+06 |
| Aluminum | 177.0 | 2.42 | 2.42E+06 |
| TaSiN | 27.2 | 2.42 | 2.42E+06 |
| BaCaO | 3.0 | 1.76 | 1.76E+06 |
| $Al_2O_3$ | 30.0 | 3.46 | 3.46E+06 |
| WSiN | 27.21 | 2.00 | 2.00E+06 |
| TEOS | 1.37 | 2.16 | 2.16E+06 |
| PSG | 1.0 | 1.33 | 1.33E+06 |
| Silicon | 140.0 | 1.65 | 1.65E+06 |
| Plastic | 0.335 | 1.93 | 1.93E+06 |
| Activation Layer | 0.05 | 1.07 | 1.07E+06 |
| Air | 2.63E−02 | 0.00117 | 1.17E+03 |
| $Si_3N_4$ | 1.2 | 2.0 | 2.00E+06 |

As can be seen in the above Table 1, y-doped SiN, Aluminum, TaSiN, $Al_2O_3$, WSiN, and Silicon have relatively higher thermal conductivity properties relative to, for example, BaCaO, TEOS, PSG, Plastics, air, and $Si_3N_4$. Non-doped silicon mononitride (SiN) has similar material properties as $Si_3N_4$.

With this information, the thermal diffusion layer (402) functions to ensure that the heat produced by the heating elements (201) do not penetrate through the sliver die (101) to the silicon layer (403). Because silicon has such a high thermal conductivity relative to other materials described herein that may be used as the thermal diffusion layer (402), without the thermal diffusion layer (402), the silicon may simply sink the heat produced by the heating elements (201) out the bottom of the sliver die (101) opposite arrow D. This would result in the heat produced by the heating elements (201) not property heating the print medium to produce an image, and would result in a negatively effected image quality.

Further, the passivation layer (504), functioning to add mechanical robustness to the thermal contact die (100), electrically isolate the thermal contact die (100), and protect the print medium from burning if the print medium were to come into direct contact with the heating element (201), also aids in heat transfer from the heating elements (201) within the sliver die (101) to the print medium in a controlled and consistent manner. Thus, the thermal diffusion layer (402) and the passivation layer (504) serve to conduct heat generated by the heating elements (201) to move in the direction of arrow D and not into layers below the thermal diffusion layer (402) such as the silicon layer (403).

The example of FIG. 5 may further include a ceramic layer (502) on which the thermal contact die (100) sits. The ceramic layer (502) may be approximately 1,200 μm thick, and may be made of, for example, alumina or other ceramic materials. The ceramic layer (502) may be disposed on a backing plate (503). The backing plate (503) may be approximately 2,500 μm thick, and may be made of aluminum. Thus, in the example of FIG. 5, the thermal contact die (100) may be supported by the ceramic layer (502) and backing plate (503).

Figure 6:
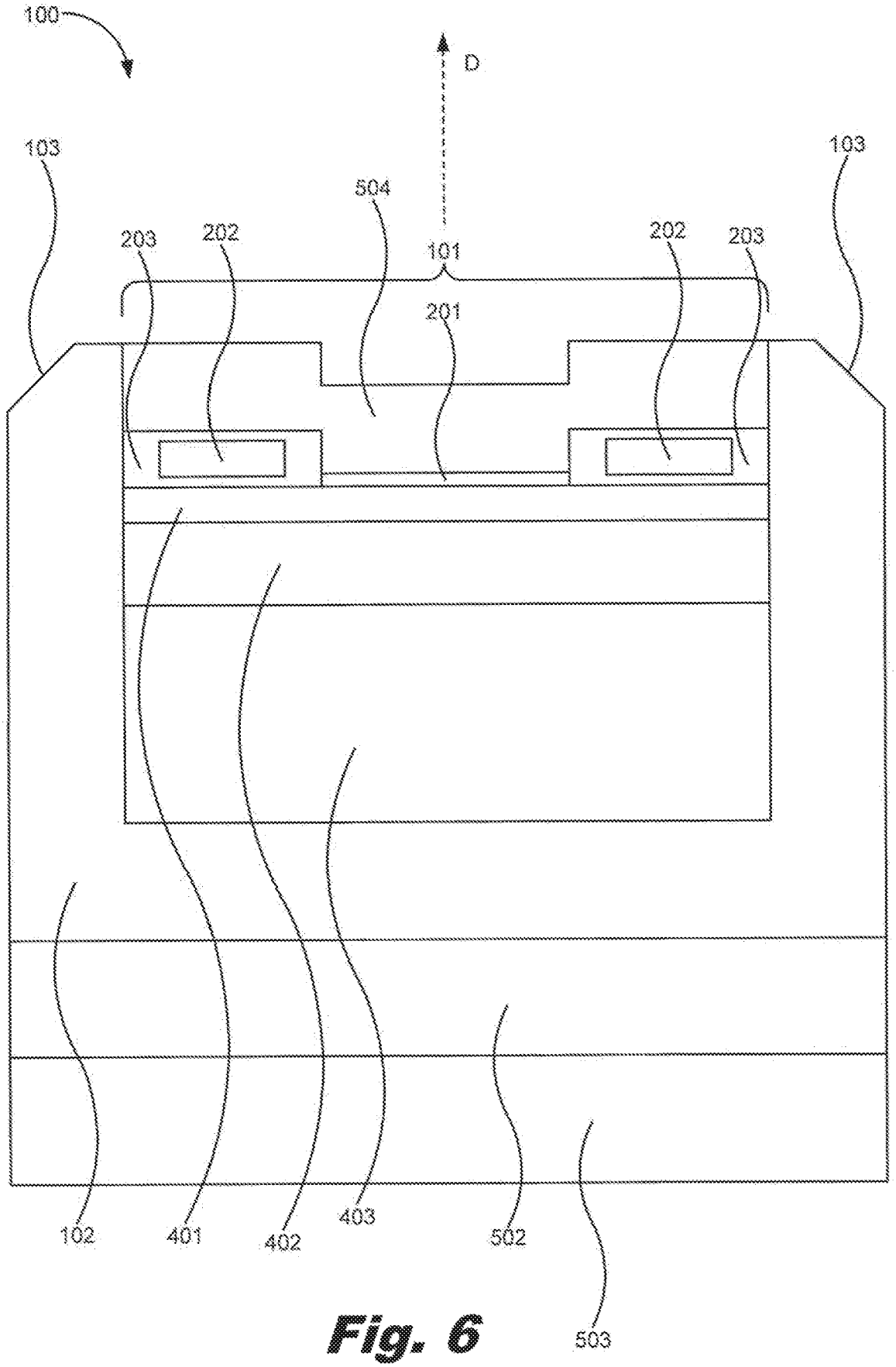
FIG. 6 is a cutaway view of a thermal contact die along line B of FIG. 1, according to still another example of the principles described herein.

FIG. 6 is a cutaway view of a thermal contact die (100) along line B of FIG. 1, according to still another example of the principles described herein. Those elements similarly numbered in FIG. 6 relative to FIGS. 1 through 5 are described above in connection with FIGS. 1 through 5, and other portions herein. The example of FIG. 6 may include a portion of the moldable material (102) surrounding the silicon layer (403) on three sides with a portion of the moldable material (102) interposed between the silicon layer (403) and the ceramic layer (502) and backing plate (503). In this manner, the silicon layer (403) is isolated from the ceramic layer (502) and backing plate (503).

Figure 7:
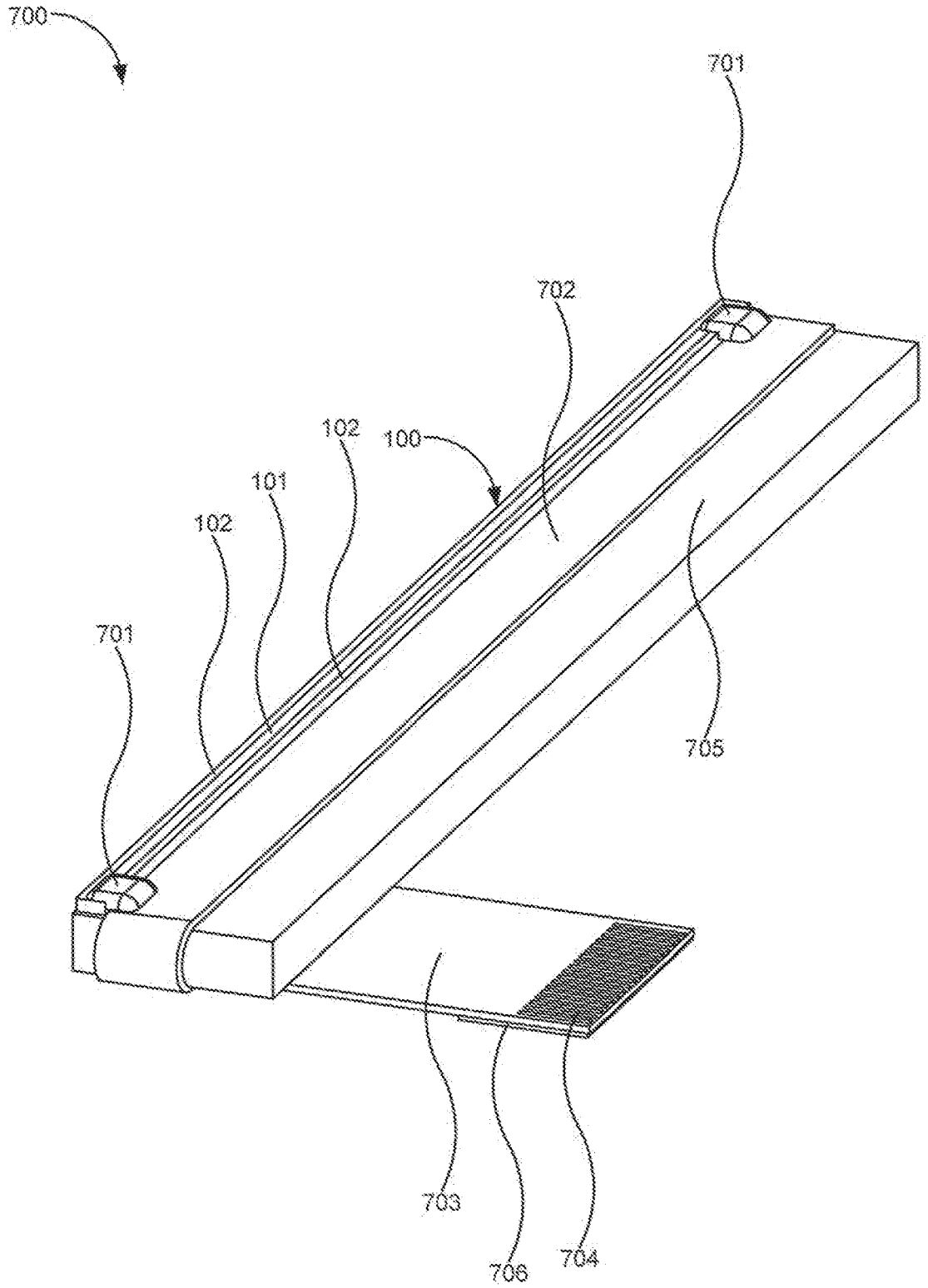
FIG. 7 is a perspective view of a print bar including a thermal contact device, according to one example of the principles described herein.

FIG. 7 is a perspective view of a print bar (700) including a thermal contact device (100), according to one example of the principles described herein. The print bar (700) may include a number of electrical interconnects (701) electrically coupled to the heating elements (201) and heating element drivers (202) of the sliver die (101) of the thermal contact device (100). The electrical interconnects (701) may electrically couple the thermal contact device (100) to a flex circuit (702). In one example, electrical coupling of the electrical interconnects (701) to the elements of the thermal contact device (100) may be made using a number of wirebonds. The electrical interconnects (701) may be located at and coupled to the ends of the thermal contact device (100) in order to be outside a print zone, and, in turn, minimize impact to the print medium feed path.

The flex circuit (702) may be a two-layer flex circuit coupled to a heat sink (705) such as an aluminum heat sink using, for example, a pressure sensitive adhesive. The heat sink (705) may be approximately 2 to 3 millimeters (mm) thick. The thermal contact device (100) may be coupled to the heat sink (705) using a thin thermal adhesive bond line. In the example of FIG. 5, the silicon layer (403) is thermally coupled to the backing plate (503). In this example, the backing plate (503) may be the heat sink (705) depicted in FIG. 7. The heat sink (705) may be any type of heat exchanger or passive heat exchange device that transfers waste heat generated by the heating elements (201) of the sliver die (101) to an ambient space such as ambient air.

The flex circuit (702) may run the length of the thermal contact device (100) in order to electrically couple to both electrical interconnects (701) located at the two ends of the thermal contact device (100). Further, the flex circuit (702) may wrap around an end of the heat sink (705) in order to run to a printed circuit assembly (PCA) interface (703). The PCA interface (703) may be, for example a low-insertion force (LIF) connector or a zero-insertion force (ZIF) connector that is capable of electrically coupling to a PCA. In this example, a number of contact pads (704) may be included on the PCA interface (703) in order to provide an electrical interface between the PCA interface (703) and electrical components of, for example, a thermal contact printing device in which the print bar (700) is included. In one example, the PCA interface (703) may be stiffened with a pressure sensitive adhesive (708).

Figure 8:
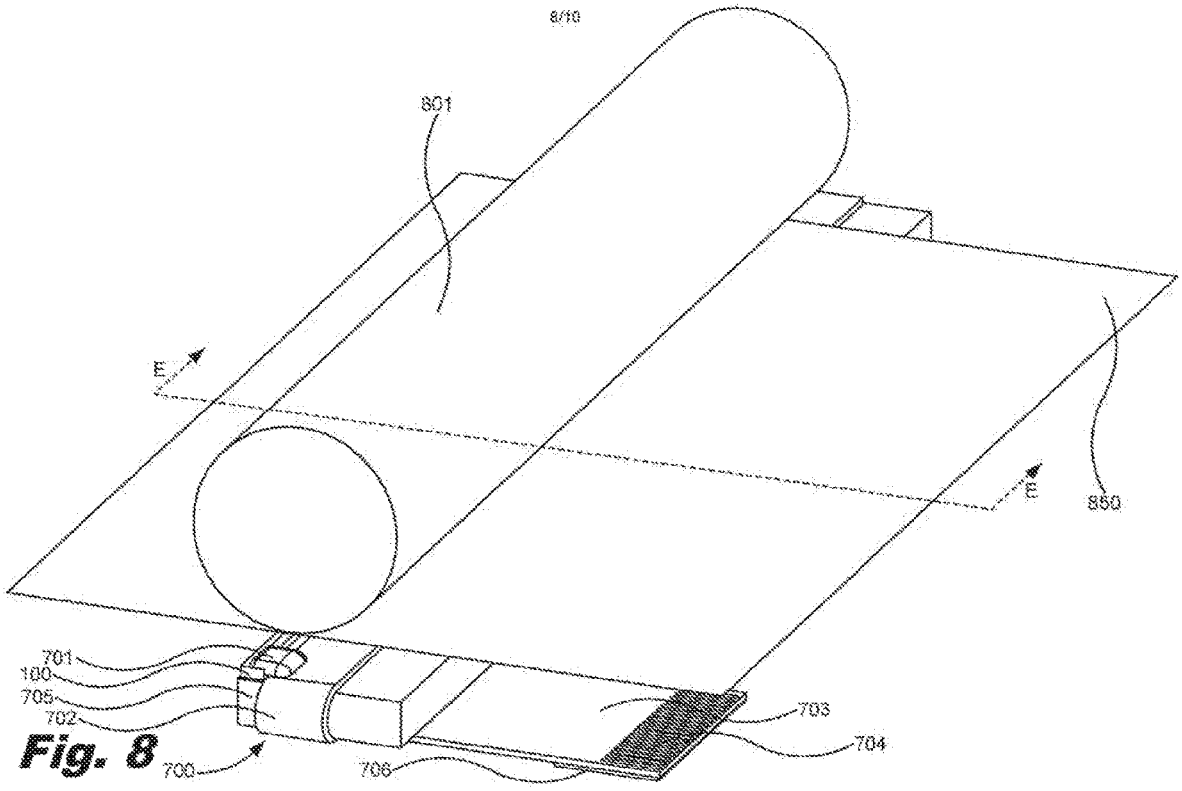
FIG. 8 is a perspective view of a print bar including a thermal contact device and a pinch roller, according to one example of the principles described herein.
Figure 9:
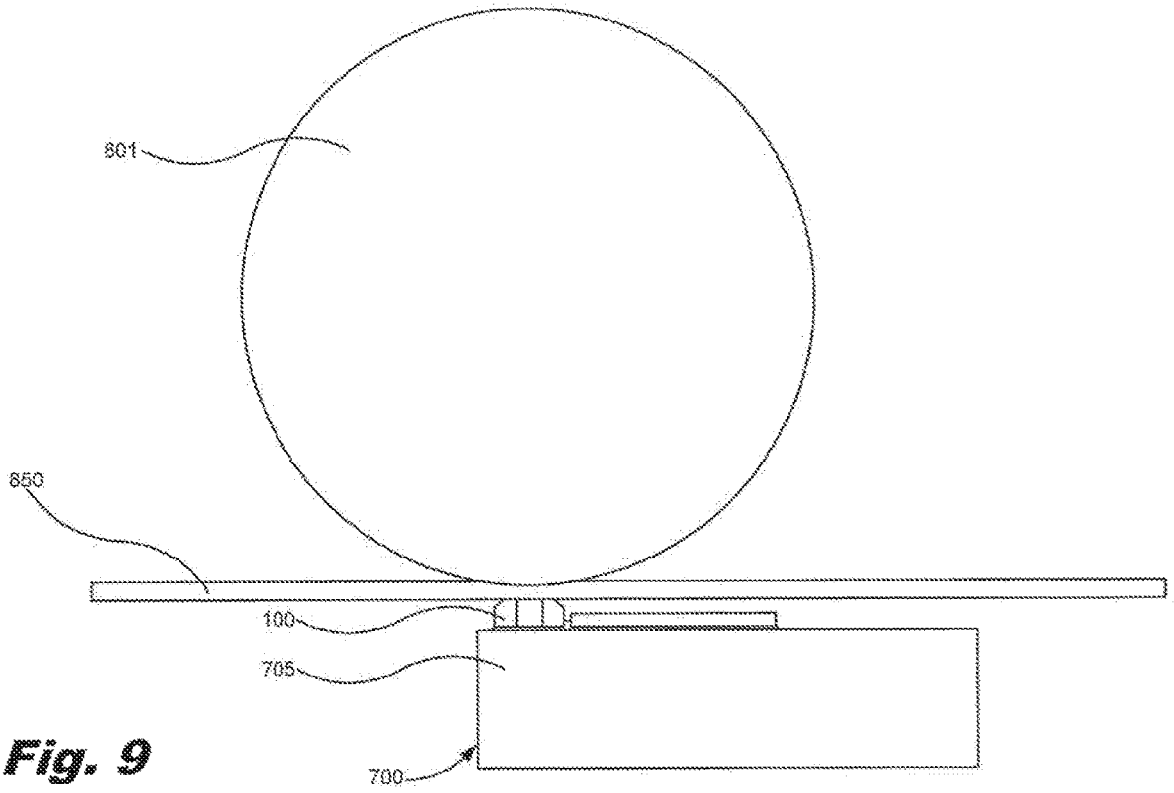
FIG. 9 is a side plan view of the print bar along line E of FIG. 8, including the thermal contact device and the pinch roller, according to one example of the principles described herein.

FIG. 8 is a perspective view of a print bar (700) including a thermal contact device (100) and a pinch roller (801), according to one example of the principles described herein. Further, FIG. 9 is a side plan view of the print bar along line E of FIG. 8, including the thermal contact device and the pinch roller, according to one example of the principles described herein. As depicted in FIGS. 8 and 9, a print medium (850) may be fed into engagement between the thermal contact device (100) and the pinch roller (850). As the print medium (850) travels between the thermal contact device (100) and the pinch roller (850), the medium is pressed against the thermal contact device (100) and the heat produced by the individual heating elements (201) of the thermal contact device (100) causes the print medium (850) to be written to. Mechanical contact of the pinch roller (801) is achieved by overmolding the sliver die (101) such that the sliver die (101) is coplanar with the moldable material (102). The thermal contact printing device in which the print bar (700) is included may be a dye diffusion thermal transfer printing device, a direct thermal printing device, a direct thermal transfer printing device, or another thermal contact printing device.

FIG. 10 is a table (1000) depicting a thermal profile of two adjacent heating elements (201) within a thermal contact die (100), according to one example of the principles described herein. The various simulations were conducted with and without a thermal diffusion layer (402), and with and without a layer of moldable material (102). As the data for the various runs indicates, thermal efficiency may be achieved by tuning the thickness of the various layers including the passivation layer (504), the thermal diffusion layer (402), the silicon layer (403), and the moldable material (102). The thermal diffusion layer (402) provides for such an increase in thermal efficiency by causing the silicon layer (403) to have an increased thermal resistivity, and causes more heat produced by the heating elements (201) to move out of the architecture of the thermal contact die (100) to a print medium. Further, the data in the table of FIG. 10 indicates that the inclusion of heating element drivers (202) on the sliver die (101) provides for higher thermals to be achieved. Still further, the presence or thickness of the moldable material (102) such as the EMC does not significantly affect the thermal efficiency. Yet further, 25 volts (V) or higher driving voltages provide higher temperatures as well.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the application specific control logic included with or as part of the heating element drivers (202) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a thermal contact device may include a thermal contact die embedded in a moldable material. The thermal contact die may include a number of resistors integrated into the thermal contact die, and a number of heater drivers integrated into the thermal contact die and electronically coupled to the resistors. The moldable material is coplanar with a thermal contact side of the thermal contact device. Further, the moldable material includes at least one gradient edge along a medium feed path.

This thermal contact device may improve heat transfer to the print medium in short time scales while increasing thermal image quality, and improve thermal coupling to the heat sink for long time scale printing with a thin narrow silicon with a buried poly-silicon layer. The silicon layer provides fully integrated heater element drivers with the heating elements to enable CMOS scaling capabilities. Further, this arrangement provides simpler drive electronics to improve hardware costs by at least 50% compared to other thermal contact device costs.

Further, higher density of heating elements per linear measurement may be provided within the thermal contact device than may be provided within, for example, a ceramic thin-film-based fluid ejection device that includes direct drive heaters with off-chip drivers. Further, the integrated heating element drivers allow for the transmission of serial data as opposed to transmission of parallel data using direct drive heaters with off-chip drivers. Further, more efficient and cost effective mechanical contact of a pinch roller is achieved by overmolding the silicon die coplanar with moldable material. A gradient edge such as a beveled or groove cut edge formed during singulation on the moldable material allows for the print medium tolerance to be moved further away from the printing zone.

Still further, a buried, doped, diffusion layer approximately 10μ thick located inside the silicon and underneath the heating elements make the silicon layer more thermally resistive for heat to move out of the architecture. The thermal contact device may achieve a higher density of heating elements per linear measurement than may be provided within a ceramic thin-film-based that includes direct drive heaters with off-chip drivers. Further, a number of trenches between the heater resistors to reduce or eliminate cross-talk between the heating elements.

The preceding description has been presented to illustrate and describe examples of the principles described. This description is not intended to be exhaustive or to limit these principles to any precise form disclosed. Many modifications and variations are possible in light of the above teaching.

What is claimed is:

1. A thermal contact device comprising:

a thermal contact die embedded in a moldable material, the thermal contact die comprising:

a number of resistors integrated into the thermal contact die; and a number of heater drivers integrated into the thermal contact die and electronically coupled to the resistors, wherein the moldable material is coplanar with a thermal contact side of the thermal contact device, and wherein the moldable material comprises at least one gradient edge along a medium feed path.

2. The thermal contact device of claim 1, further comprising a thermal diffusion layer within the thermal contact die to increase the thermal resistivity of the thermal contact die.

3. The thermal contact device of claim 1, wherein the thermal diffusion layer comprises a silicate glass, a phosphosilicate glass (PSG), a borophosphosilicate glass (BPSG), a silicon nitride ($Si_3N_4$), silicon carbide (SiC), silicon mononitride (SiN), other thermal diffusion materials, or combinations thereof.

4. The thermal contact device of claim 1, further comprising application specific control logic within the thermal contact die.

5. The thermal contact device of claim 1, wherein the heater drivers are field effect transistors (FETs).

6. The thermal contact device of claim 1, wherein the silicon die is between 50 and 675 micrometers (μm) in thickness.

7. A print bar comprising:

a plurality of thermal contact dies embedded in a moldable material, each of the thermal contact dies comprising:

a number of resistors integrated into the thermal contact die;

a number of heater drivers integrated into the thermal contact die and electronically coupled to the resistors; and a thermal diffusion layer within the thermal contact die to increase the thermal resistivity of the thermal contact die.

8. The print bar of claim 7, wherein:

the moldable material is coplanar with a thermal contact side of the thermal contact device, and the moldable material comprises at least one gradient edge along a medium feed path.

9. The print bar of claim 7, wherein the thermal diffusion layer comprises a silicate glass, a phosphosilicate glass (PSG), borophosphosilicate glass (BPSG), silicon nitride ($Si_3N_4$), silicon carbide (SiC), silicon mononitride (SiN), or combinations thereof.

10. The print bar of claim 7, wherein instructions to actuate the resistors are sent to the heater drivers in serial.

11. The print bar of claim 7, wherein the thermal contact dies further comprise a passivation layer deposited on the resistors.

12. A thermal contact structure, comprising:

a thermal contact die at least partially overmolded in a moldable material, the thermal contact die comprising:

a number of resistors integrated into the thermal contact die; and a number of heater drivers integrated into the thermal contact die and electronically coupled to the resistors, wherein the moldable material extends from the thermal contact die past a print zone.

13. The thermal contact structure of claim 12, wherein:

the moldable material is coplanar with a thermal contact side of the thermal contact device, and the moldable material comprises at least one gradient edge along a medium feed path.

14. The thermal contact structure of claim 12, further comprising a heat exchanger thermally coupled to the thermal contact die.

15. The thermal contact structure of claim 12, further comprising a number of trenches defined between the resistors.

* * * * *